US009987864B2

(12) United States Patent
Nakano et al.

(10) Patent No.: US 9,987,864 B2
(45) Date of Patent: Jun. 5, 2018

(54) TABLET PRINTING APPARATUS AND TABLET PRINTING METHOD

(71) Applicant: SCREEN Holdings Co., Ltd., Kyoto-shi, Kyoto (JP)

(72) Inventors: Nobuyuki Nakano, Kyoto (JP); Takashi Gama, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days. days.

(21) Appl. No.: 15/313,752

(22) PCT Filed: May 12, 2015

(86) PCT No.: PCT/JP2015/063591

§ 371 (c)(1),
(2) Date: Nov. 23, 2016

(87) PCT Pub. No.: WO2015/182368

PCT Pub. Date: Dec. 3, 2015

(65) Prior Publication Data

US 2017/0182820 A1 Jun. 29, 2017

(30) Foreign Application Priority Data

May 28, 2014 (JP) ..... 2014-109859

(51) Int. Cl.
*B41J 3/407* (2006.01)
*A61J 3/07* (2006.01)
(Continued)

(52) U.S. Cl.
CPC ..... *B41J 29/38* (2013.01); *A61J 3/007* (2013.01); *B41J 2/01* (2013.01); *B41J 3/4073* (2013.01)

(58) Field of Classification Search
CPC ... B41J 2/01; B41J 3/407; B41J 3/4073; B41J 3/60; B41J 13/0009; B41J 29/38;
(Continued)

(56) References Cited

U.S. PATENT DOCUMENTS 4,757,382 A * 7/1988 Kaziura ..... B65G 21/2036 198/689.1
5,423,252 A * 6/1995 Yamamoto ..... B41F 17/36 101/35
(Continued)

FOREIGN PATENT DOCUMENTS

JP 06-143539 A 5/1994
JP 09-187915 A 7/1997
(Continued)

OTHER PUBLICATIONS

International Preliminary Report on Patentability dated Dec. 8, 2016, issued in International Application No. PCT/JP2015/063591. (w/ English translation).
(Continued)

*Primary Examiner* — Anh T. N. Vo
(74) *Attorney, Agent, or Firm* — McDermott Will & Emery LLP

(57) ABSTRACT

A first score line camera captures an image of one sides of a plurality of tablets being conveyed by a conveyor drum. During transfer from the conveyor drum to a first conveyor belt, all the tablets are turned upside down while their directional properties are maintained. A second score line camera captures an image of opposite side of the tablets being conveyed by the first conveyor belt. Based on image data about both the front sides and back sides of the tablets acquired by the first and second score line cameras, a first ink-jet head performs front-side printing process on a front side of a tablet to conform to a predetermined direction relative to a score line in this front side. The second ink-jet
(Continued)

head performs back-side printing process on a back side of a tablet to conform to a direction on the back side same as the predetermined direction.

20 Claims, 8 Drawing Sheets

(51) Int. Cl.
*B41J 29/38* (2006.01)
*B41J 2/01* (2006.01)
*A61J 3/00* (2006.01)

(58) Field of Classification Search
CPC ..... B41F 17/36; B65B 5/103; B65B 57/20; A61J 3/06; A61J 3/007; A61J 3/10
See application file for complete search history.

(56) References Cited

U.S. PATENT DOCUMENTS

| | | | | |
|---|---|---|---|---|
| 6,741,731 | B1 * | 5/2004 | Yamamoto | G01N 21/9508 382/141 |
| 7,102,741 | B2 * | 9/2006 | Ackley, Jr. | B23K 26/0838 209/580 |
| 9,108,431 | B2 | 8/2015 | Hara et al. | |
| 2014/0168309 | A1 * | 6/2014 | Morita | B41J 11/42 347/16 |
| 2015/0191028 | A1 | 7/2015 | Hara et al. | |

FOREIGN PATENT DOCUMENTS

| | | | |
|---|---|---|---|
| JP | H09-206358 | A | 8/1997 |
| JP | 2011-020325 | A | 2/2011 |
| JP | 2013-13711 | A | 1/2013 |
| JP | 2013-121432 | A | 6/2013 |
| WO | 2014/013973 | A1 | 1/2014 |
| WO | 2014/013974 | A1 | 1/2014 |

OTHER PUBLICATIONS

International Search Report dated Jun. 9, 2015, issued in International Application No. PCT/JP2015/063591.
Taiwanese Office Action dated Oct. 20, 2016, issued in Taiwanese Application No. 104117026. (w/ partial English translation).
Office Action issued in corresponding Japanese Patent Application No. 2014-109859, dated Sep. 19, 2017 (With full English translation).
Korean Office Action issued in Korean Patent Application No. 10-2016-7032954, dated Sep. 12, 2017 (With Partial English Translation).
Office Action issued in corresponding Japanese Patent Application No. 2017-002483, dated Nov. 7, 2017 (with English translation).
Office Action issued in corresponding Japanese Patent Application No. 2017-002484, dated Nov. 14, 2017 (with English translation).
Office Action issued in corresponding Japanese Patent Application No. 2017-002485, dated Nov. 14, 2017 (with English translation).
Decision of Refusal issued in Japanese Patent Application No. JP2014-109859, dated Mar. 6, 2018 (with English translation).
Office Action issued in Korean Patent Application 10-2016-7032954, dated Mar. 27, 2018 (with partial English translation).

* cited by examiner

TABLET PRINTING APPARATUS AND TABLET PRINTING METHOD

CROSS-REFERENCE TO RELATED APPLICATIONS

This application is the U.S. National Phase of PCT/JP2015/063591 filed May 12, 2015, which claims priority to Japanese Patent Application No. 2014-109859 filed May 28, 2014. The subject matter of each is incorporated herein by reference in entirety.

TECHNICAL FIELD

The present invention relates to a tablet printing apparatus and a tablet printing method that perform printing process on a front side and a back side of a tablet having a mark at the front side such as a score line for identification of a direction.

BACKGROUND ART

Many tablets as medicines have conventionally had printed codes for identification of the medicines. An identifying code printed on a tablet is typically a company code representing a manufacturer or a product code for discriminating a product. Such an identifying code is used mainly for preparation of a medicine at a medical institution or pharmacy. To prevent mistaken administration of a tablet (to prevent mistaken administration of a combination of an antihypertensive and a vasopressor, for example), a tablet may be given an indication that facilitates clear recognition of the tablet by a patient. Further, there has also been a desire to assign a number to a tablet for the purpose of traceability of medicine.

The aforementioned identifying code, etc. may be engraved in a front side of a tablet. However, due to a problem relating to visibility caused by this engraving, there has been an increasing need to make a print directly on a tablet by printing. Patent literatures 1 and 2 suggest techniques of printing on a tablet using an ink-jet printer.

According to the disclosure of patent literature 1, image of a plurality of works (tablets) supplied randomly is captured to detect information about each work such as a position and a posture, and a pattern of printing on each work is generated based on the detected work, information. According to the disclosure of patent literature 2, an image of a plurality of tablets supplied randomly is captured by a line sensor camera, and print data responsive to an orientation of a score line in a tablet is generated based on the resultant image data.

PRIOR ART LITERATURES

Patent Literatures

Patent Literature 1: Japanese Patent Application Laid-Open No. 2011-20325

Patent Literature 2: Japanese Patent Application Laid-Open No. 2013-121432

SUMMARY OF INVENTION

Problems to be Solved by Invention

According to the techniques of printing on a tablet disclosed in patent literatures 1 and 2, printing process is performed only on one side of the tablet (in the case of patent literature 2, on a side with a score line). Meanwhile, printing process is expected to be performed on both a front side and a rear side of the tablet. For printing process on both the front side and the back side of the tablet, printing is desirably performed in the same direction on the front side and the back side in terms of prevention of forgery of a medical agent, for example.

Many tablets (particularly tablets without coatings) have engraved score lines used for partitioning into halves. Patent literature 2 discloses performing printing in such a manner as to conform to the orientation of a score line. If printing is performed in a direction differing between a front side and a back side of a tablet, however, print information on the back side is cut when the tablet is partitioned into halves along a score line to cause a problem of loss of an information value.

The present invention has been made in view of the aforementioned problem. It is an object of the present invention to provide a tablet printing apparatus and a tablet printing method capable of performing printing process on both a front side and a back side of a tablet in the same direction.

Means of Solving Problems

To solve the aforementioned problem, according to a first aspect of the present invention, a tablet printing apparatus performs printing process on a front side and a back side of a tablet having a mark for identification of a direction formed at the front side. The tablet printing apparatus comprises: a charging part for charging of a plurality of tablets; a first conveyor part that conveys the tablets charged from the charging part; a first image capturing part that captures an image of one sides of the tablets being conveyed by the first conveyor part; a second conveyor part that receives the tablets having been conveyed by the first conveyor part from the first conveyor part while the tablets are turned upside down and then conveys the tablets; a second image capturing part that captures an image of opposite sides of the tablets being conveyed by the second conveyor part; a first printing part that performs printing process on the opposite sides of the tablets being conveyed by the second conveyor part; a third conveyor part that receives the tablets having been conveyed by the second conveyor part from the second conveyor part while the tablets are turned upside down and then conveys the tablets; a second printing part that performs printing process on the one sides of the tablets being conveyed by the third conveyor part; and a printing controller that controls the first printing part and the second printing part based on image data acquired by the first image capturing part and image data acquired by the second image capturing part. The printing controller makes the first printing part perform front-side printing process on each tablet out of the tablets being conveyed by the second conveyor part and having a front side defining its opposite side based on front-side print data to conform to a predetermined direction relative to the mark at the front side. The printing controller makes the first printing part perform back-side printing process on each tablet out of the tablets being conveyed by the second conveyor part and having a back side defining its opposite side based on back-side print data to conform to a direction on the back side same as the predetermined direction. The printing controller makes the second printing part perform front-side printing process on each tablet out of the tablets being conveyed by the third conveyor part and having a front side defining its one side based on front-side print data to conform to the predetermined direction relative to the mark at the front side. The printing controller makes the second printing part perform back-side printing process on each tablet out of the tablets being conveyed by the third conveyor part and having a back side defining its one side based on back-side print data to conform to a direction on the back side same as the predetermined direction.

According to a second aspect, in the tablet printing apparatus according to the first aspect, the mark is a score line engraved in a front side of each tablet.

According to a third aspect, in the tablet printing apparatus according to the first aspect, each of the first conveyor part, the second conveyor part, and the third conveyor part conveys the tablets while aligning a predetermined number of tablets in a direction vertical to a conveyance direction.

According to a fourth aspect, in the tablet printing apparatus according to the third aspect, the first image capturing part captures an image of each row including the predetermined number of tablets arranged in the direction vertical to the conveyance direction of the first conveyor part.

According to a fifth aspect, the tablet printing apparatus according to the first aspect further comprises a third image capturing part that captures an image of the one sides of the tablets being conveyed by the third conveyor part. The printing controller corrects a position of printing by the second printing part based on image data acquired by the third image capturing part.

According to a sixth aspect, the tablet printing apparatus according to the first aspect further comprises: a first test camera that captures an image of a result of the printing process on the one sides of the tablets by the second printing part; and a second test camera that captures an image of a result of the printing process on the opposite sides of the tablets by the first printing part.

According to a seventh aspect, the tablet printing apparatus according to the first aspect further comprises: a first heater that heats and dries the tablets having been subjected to the printing process by the first printing part; and a second heater that heats and dries the tablets having been subjected to the printing process by the second printing part.

According to an eighth aspect, a tablet printing apparatus performs printing process on a front side and a back side of a tablet having a mark for identification of a direction formed at the front side. The tablet printing apparatus comprises: a first image capturing part that captures an image of one side of a tablet; a second image capturing part that captures an image of an opposite side of a tablet; a first printing part that performs printing process on an opposite side of a tablet; a second printing part that performs printing process on one side of a tablet; and a printing controller that controls the first printing part and the second printing part based on image data acquired by the first image capturing part and image data acquired by the second image capturing part. The printing controller makes the first printing part or the second printing part perform front-side printing process on a front side of a tablet based on front-side print data to conform to a predetermined direction relative to the mark at the front side. The printing controller makes the first printing part or the second printing part perform back-side printing process on a back side of a tablet based on back-side print data to conform to a direction on the back side same as the predetermined direction.

According to a ninth aspect, a tablet printing method performs printing process on a front side and a back side of a tablet having a mark for identification of a direction formed at the front side. The tablet printing method comprises: a first conveying step of conveying a plurality of tablets; a first image capturing step of capturing an image of one sides of the tablets being conveyed in the first conveying step; a second conveying step of conveying the tablets having been conveyed in the first conveying step while turning the tablets upside down; a second image capturing step of capturing an image of opposite sides of the tablets being conveyed in the second conveying step; a first printing step of performing printing process on the opposite sides of the tablets being conveyed in the second conveying step; a third conveying step of conveying the tablets having been conveyed in the second conveying step while turning the tablets upside down; and a second printing step of performing printing process on the one sides of the tablets be conveyed in the third conveying step. In the first printing step, based on image data acquired in the first image capturing step and image data acquired in the second image capturing step, front-side printing process is performed on each tablet out of the tablets being conveyed in the second conveying step and having a front side defining its opposite side to conform to a predetermined direction relative to the mark at the front side, and back-side printing process is performed on each tablet out of the tablets being conveyed in the second conveying step and having a back side defining its opposite side to conform to a direction on the back side same as the predetermined direction. In the second printing step, based on the image data acquired in the first image capturing step and the image data acquired in the second image capturing step, front-side printing process is performed on each tablet out of the tablets being conveyed in the third conveying step and having a front side defining its one side to conform to the predetermined direction relative to the mark at the front side, and back-side printing process is performed on each tablet out of the tablets being conveyed in the third conveying step and having a back side defining its one side to conform to a direction on the back side same as the predetermined direction.

According to a tenth aspect, in the tablet printing method according to the ninth aspect, the mark is a score line engraved in a front side of each tablet.

According to an eleventh aspect, in the tablet printing method according to the ninth aspect, in each of the first conveying step, the second conveying step, and the third conveying step, the tablets are conveyed while a predetermined number of tablets are aligned in a direction vertical to a conveyance direction.

According to a twelfth aspect, in the tablet printing method according to the eleventh aspect, in the first image capturing step, an image of each row is captured that includes the predetermined number of tablets arranged in the direction vertical to the conveyance direction in the first conveying step.

According to a thirteenth aspect, the tablet printing method according to the ninth aspect further comprises a third image capturing step of capturing an image of the one sides of the tablets being conveyed in the third conveying step. In the second printing step, a printing position is corrected based on image data acquired in the third image capturing step.

According to a fourteenth aspect, the tablet printing method according to the ninth aspect further comprises: a first testing step of capturing an image of a result of the printing process on the one sides of the tablets in the second printing step; and a second testing step of capturing an image of a result of the printing process on the opposite sides of the tablets in the first printing step.

According to a fifteenth aspect, the tablet printing method according to the ninth aspect further comprises: a first drying step of heating and drying the tablets having been subjected to the printing process in the first printing step; and a second drying step of heating and drying the tablets having been subjected to the printing process in the second printing step.

According to a sixteenth aspect, a tablet printing method performs printing process on a front side and a back side of a tablet having a mark for identification of a direction formed at the front side. The tablet printing method comprises: a first image capturing step of capturing an image of one side of a tablet; a second image capturing step of capturing an image of an opposite side of a tablet; a first printing step of performing printing process on an opposite side of a tablet; and a second printing step of performing printing process on one side of a tablet. In the first printing step and the second printing step, based on image data acquired in the first image capturing step and image data acquired in the second image capturing step, front-side printing process is performed on a front side of a tablet to conform to a predetermined direction relative to the mark at the front side, and back-side printing process is performed on a back side of a tablet to conform to a direction on the back side same as the predetermined direction.

Advantageous Effects of Invention

According to the tablet printing apparatus of the first to seventh aspects, the front-side printing process is performed on each tablet out of the tablets being conveyed by the second conveyor part and having a front side defining its opposite side based on the front-side print data to conform to a predetermined direction relative to the mark at the front side. The back-side printing process is performed on each tablet out of the tablets being conveyed by the second conveyor part and having a back side defining its opposite side based on the back-side print data to conform to a direction on the back side same as the predetermined direction. The front-side printing process is performed on each tablet out of the tablets being conveyed by the third conveyor part and having a front side defining its one side based on the front-side print data to conform to the predetermined direction relative to the mark at the front side. The back-side printing process is performed on each tablet out of the tablets being conveyed by the third conveyor part and having a back side defining its one side based on the back-side print data to conform to a direction on the back side same as the predetermined direction. Thus, prints are formed on a front side and a back side of a tablet, both in the aforementioned predetermined direction relative to the mark. This makes it possible to perform the printing process on both the front side and the back side of the tablet in the same direction.

According to the tablet printing apparatus of the eighth aspect, the front-side printing process is performed on a front side of a tablet based on the front-side print data to conform to a predetermined direction relative to the mark at the front side. The back-side printing process is performed on a back side of a tablet based on the back-side print data to conform to a direction on the back side same as the predetermined direction. Thus, prints are formed on a front side and a back side of a tablet, both in the aforementioned predetermined direction relative to the mark. This makes it possible to perform the printing process on both the front side and the back side of the tablet in the same direction.

According to the tablet printing method of the ninth to fifteenth aspects, based on the image data acquired in each of the first image capturing step and the second image capturing step, the front-side printing process is performed on each tablet out of the tablets being conveyed in the second conveying step and having a front side defining its opposite side to conform to a predetermined direction relative to the mark at the front side, and the back-side printing process is performed on each tablet out of the tablets being conveyed in the second conveying step and having a back side defining its opposite side to conform to a direction on the back side same as the predetermined direction. The front-side printing process is performed on each tablet out of the tablets being conveyed in the third conveying step and having a front side defining its one side to conform to the predetermined direction relative to the mark at the front side, and the back-side printing process is performed on each tablet out of the tablets being conveyed in the third conveying step and having a back side defining its one side to conform to a direction on the back side same as the predetermined direction. Thus, prints are formed on a front side and a back side of a tablet, both in the aforementioned predetermined direction relative to the mark. This makes it possible to perform the printing process on both the front side and the back side of the tablet in the same direction.

According to the tablet printing method of the sixteenth aspect, based on the image data acquired in each of the first image capturing step and the second image capturing step, the front-side printing process is performed on a front side of a tablet to conform to a predetermined direction relative to the mark at the front side, and the back-side printing process is performed on a back side of a tablet to conform to a direction on the back side same as the predetermined direction. Thus, prints are formed on a front side and a back side of a tablet, both in the aforementioned predetermined direction relative to the mark. This makes it possible to perform the printing process on both the front side and the back side of the tablet in the same direction.

DESCRIPTION OF EMBODIMENT(S)

An embodiment of the present invention will be described in detail below by referring to the accompanying drawings.

Figure 1:
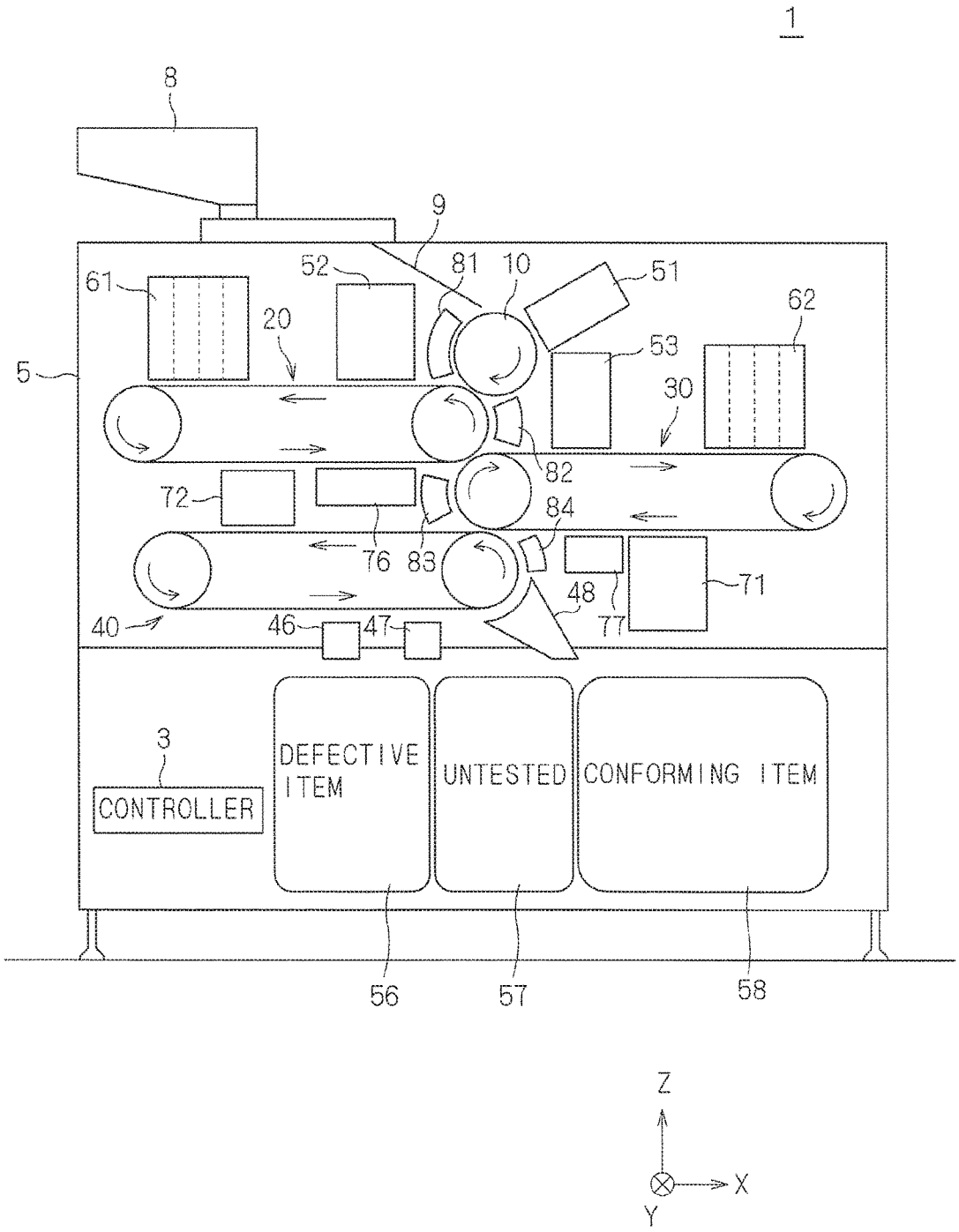
FIG. 1 shows an entire structure of a tablet printing apparatus in outline according to the present invention.

FIG. 1 shows an entire structure of a tablet printing apparatus 1 in outline according to the present invention. The tablet printing apparatus 1 is an apparatus that performs printing process on both a front side and a back side of a tablet. To clearly show a relationship in terms of direction between FIGS. 1 and 2, an XYZ orthogonal coordinate system is given to these drawings. This coordinate system defines a Z-axis direction as a vertical direction and an XY plane as a horizontal plane. In FIG. 1 and its subsequent drawings, the dimensions of components and the number of components are shown in exaggeration or in simplified form, as appropriate, for the sake of easier understanding.

The tablet printing apparatus 1 includes a hopper 8, a conveyor drum 10, a first conveyor belt 20, a second conveyor belt 30, a third conveyor belt 40, a first score line camera 51, a second score line camera 52, a third score line camera 53, a first ink-jet head 61, and a second ink-jet head 62 forming principal elements of the tablet printing apparatus 1. The tablet printing apparatus 1 further includes a controller 3 that controls each drive part of the apparatus to develop printing process on a tablet.

The hopper 8 is provided above a ceiling part of a casing 5 of the tablet printing apparatus 1. The hopper 8 is a charging part from which a large number of tablets are charged collectively into the apparatus. A plurality of tablets charged from the hopper 8 is guided to the conveyor drum 10 along a slider 9. The elements except the hopper 8 are arranged inside the casing 5 of the tablet printing apparatus 1.

Figure 2:
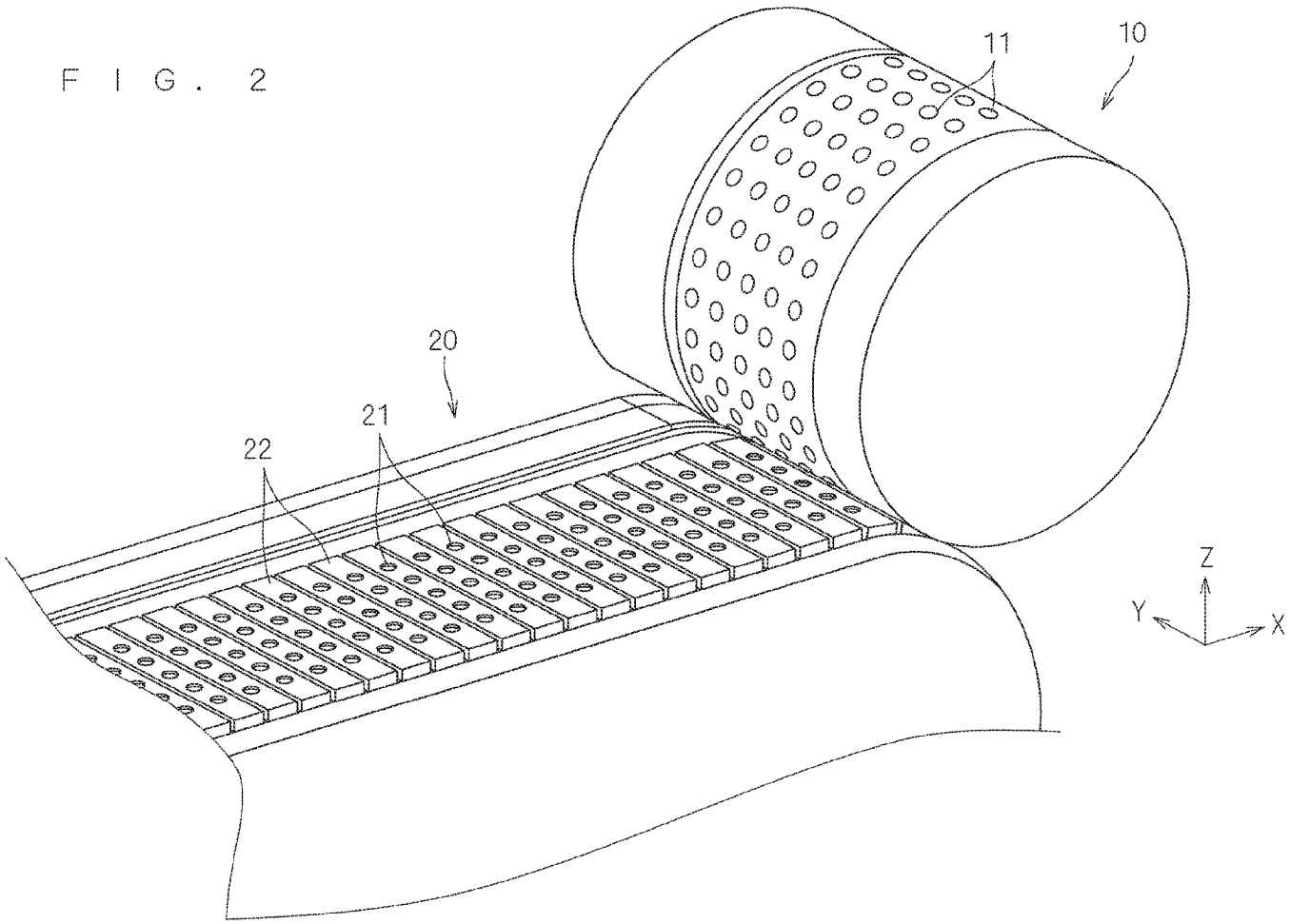
FIG. 2 is a perspective view showing the appearance of a conveyor drum and that of a first conveyor belt.

FIG. 2 is a perspective view showing the appearance of the conveyor drum 10 and that of the first conveyor belt 20. The conveyor drum (first conveyor part) 10 has a substantially cylindrical shape and is rotated clockwise on the plane of paper of FIG. 1 about a center axis extending in a Y-axis direction by a rotation drive motor not shown in the drawings. As shown in FIG. 2, a plurality of suction holes 11 is formed in the outer circumferential surface of the conveyor drum 10. In this embodiment, the suction holes 11 are arranged in five columns at equal spaces along the center axis of the conveyor drum 10. The suction holes 11 in five columns are arranged as a group and such groups extend over multiple rows at equal spaces in the circumferential direction of the outer circumferential surface of the conveyor drum 10.

The shape of the suction hole 11 conforms to the shape of a tablet as a subject of printing process. In this embodiment, a tablet of a disc-like shape is to be processed in this embodiment. Thus, the suction hole 11 is formed into a circular shape. The suction hole 11 has a size slightly large than that of a tablet. For example, if a tablet having a disc-like shape has a diameter of about 10 mm, the diameter of the suction hole 11 is set at about 12 mm.

Each of the suction holes 11 has a bottom where a small hole smaller than the suction hole 11 is provided. These suction holes 11 are communicatively coupled through the respective small holes to a suction mechanism (not shown in the drawings) provided inside the conveyor drum 10. Actuating this suction mechanism allows negative pressure lower than atmospheric pressure to act on each of the suction holes 11. In this way, one tablet is allowed to be held under suction in each suction hole 11 in the conveyor drum 10.

The conveyor drum 10 includes a blowing mechanism provided inside the conveyor drum 10 and in the vicinity of a position facing the first conveyor belt 20. This blowing mechanism blows pressurized air toward the aforementioned small hole provided at the bottom of the suction hole 11. The blow of air from the blowing mechanism allows pressure higher than atmospheric pressure to act on the suction hole 11. As a result, a tablet can be released from a sucked condition formed in the suction hole 11. In this way, while suction power generated by the suction mechanism acts on the plurality of suction holes 11 entirely provided in the conveyor drum 10, the suction holes 11 in five columns and in one row facing the first conveyor belt 20 can be released from the suction by the blowing mechanism.

The first conveyor belt (second conveyor part) 20 is formed by looping a belt-like structure having a connection of a plurality of holder plates 22 around a pair of pulleys. The pair of pulleys is rotated by a drive motor not shown in the drawings to rotate the belt-like structure formed by the holder plates 22 in a direction indicated by arrows of FIG. 1. The first conveyor belt 20 is installed in such a manner that a part of the belt-like structure formed by the holder plates 22 faces the outer circumferential surface of the conveyor drum 10 at a position adjacent to this outer circumferential surface.

As shown in FIG. 2, each of the holder plates 22 is provided with a plurality of suction holes 21 at equal spaces in a belt width direction (Y-axis direction). In this embodiment, the suction holes 21 provided to each holder plate 22 are arranged in five columns in the Y-axis direction. The shape and the size of the suction hole 21 itself in the first conveyor belt 20 are the same as those of the suction hole 11 in the conveyor drum 10. The spaces between the suction holes 21 aligned in five columns in each holder plate 22 are also the same as those of the suction holes 11 aligned in five columns along the center axis of the conveyor drum 10.

Like the aforementioned suction hole 11, each of the suction holes 21 has a bottom where a small hole smaller than the suction hole 21 is provided. These suction holes 21 are communicatively coupled through the respective small holes to a suction mechanism provided inside the first conveyor belt 20. Actuating this suction mechanism allows negative pressure lower than atmospheric pressure to act on each of the suction holes 21. In this way, one tablet is allowed to be held under suction in each suction hole 21 in the first conveyor belt 20.

The first conveyor belt 20 includes a blowing mechanism provided inside the first conveyor belt 20 and in the vicinity of a position facing the second conveyor belt 30 described later. This blowing mechanism blows pressurized air toward the aforementioned small hole provided at the bottom of the suction hole 21. The blow of air from the blowing mechanism allows pressure higher than atmospheric pressure to act on the suction hole 21. As a result, a tablet can be released from a sucked condition formed in the suction hole 21.

Referring next to the second conveyor belt (third conveyor part) 30 and the third conveyor belt (fourth conveyor part) 40, the structures of these belts are substantially the same as that of the first conveyor belt 20. Specifically, each of the second and third conveyor belts 30 and 40 is formed by looping a belt-like structure having a connection of a plurality of holder plates around a pair of pulleys. The pair of pulleys is rotated by a drive motor not shown in the drawings to rotate each of the second and third conveyor belts 30 and 40 in a direction indicated by arrows of FIG. 1. The second conveyor belt 30 is installed in such a manner that a part of the belt-like structure formed by the holder plates faces the first conveyor belt 20 at a position adjacent to the first conveyor belt 20. Likewise, the third conveyor belt 40 is installed in such a manner that a part of the belt-like structure formed by the holder plates faces the second conveyor belt 30 at a position adjacent to the second conveyor belt 30.

Each of the holder plates of each of the second and third conveyor belts 30 and 40 is also provided with a plurality of suction holes (in this embodiment, in five columns) at equal spaces in a belt width direction (Y-axis direction). Like in the aforementioned case, a suction mechanism provided inside the second conveyor belt 30 allows negative pressure lower than atmospheric pressure to act on the suction hole in the second conveyor belt 30. In this way, one tablet is allowed to be held under suction in each suction hole in the second conveyor belt 30. The second conveyor belt 30 includes a blowing mechanism provided inside the second conveyor belt 30 and in the vicinity of a position facing the third conveyor belt 40. This blowing mechanism blows air to make pressure higher than atmospheric pressure act on the suction hole in the second conveyor belt 30. As a result, a tablet can be released from a sucked condition formed in this suction hole.

Likewise, a suction mechanism provided inside the third conveyor belt 40 allows negative pressure lower than atmospheric pressure to act on the suction hole in the third conveyor belt 40. In this way, one tablet is allowed to be held under suction in each suction hole in the third conveyor belt 40. The third conveyor belt 40 includes blowing mechanisms provided at three positions inside the third conveyor belt 40. These blowing mechanisms blow air to make pressure higher than atmospheric pressure act on the suction hole in the third conveyor belt 40. As a result, a tablet can be released from a sucked condition formed in this suction hole.

All the blowing mechanisms provided at the three positions in the third conveyor belt 40 blow air downwardly or obliquely downwardly. Thus, as a result of blow of air from one of the blowing mechanisms at the three positions and arranged at a position facing a conforming item duct 48, a tablet can be released from a sucked condition formed in the suction hole and can be released to the conforming item duct 48. The tablet having been released to the conforming item duct 48 is collected in a conforming item collection box 58. Further, as a result of blow of air from a blowing mechanism arranged at a position facing an untested duct 47, a tablet can be released from a sucked condition formed in the suction hole and can be released to the untested duct 47. The tablet having been released to the untested duct 47 is collected in an untested box 57. Further, as a result of blow of air from a blowing mechanism arranged at a position facing a defective item duct 46, a tablet can be released from a sucked condition formed in the suction hole and can be released to the defective item duct 46. The tablet having been released to the defective item duct 46 is collected in a defective item box 56.

Referring next to the first score line camera first image capturing part) 51, the second score line camera (second image capturing part) 52, and the third score line camera (third image capturing part) 53, each of these cameras is an image capturing part for capturing an image of a predetermined area and is a CCD camera, for example. The first score line camera 51 is installed to face the outer circumferential surface of the conveyor drum 10 so as to set an image capture area at this outer circumferential surface. The first score line camera 51 is provided at a position that allows image capture of a place downstream from the slider 9 in a conveyance direction of the conveyor drum 10. The first score line camera 51 captures an image of a plurality of tablets being conveyed while being held under suction in the suction holes 11 in the conveyor drum 10. The size of an area of image capture by the first score line camera 51 can be determined appropriately. Meanwhile, the first score line camera 51 is to capture an image of the cylindrical circumferential surface of the conveyor drum 10 and it is difficult to bring a wide range of this cylindrical circumferential surface into focus. For this reason, an area of image capture by the first score line camera 51 is only required to have a size that allows image capture at least of tablets in five columns and in one row facing the first score line camera 51.

The second score line camera 52 is installed to face a conveyance surface of the first conveyor belt 20 so as to set an image capture area at this conveyance surface. The second score line camera 52 is provided at a position that allows image capture of a place downstream from a position facing the conveyor drum 10 and upstream from the first ink-jet head 61 in a conveyance direction of the first conveyor belt 20. The second score line camera 52 captures an image of a plurality of tablets being conveyed while being held under suction by the first conveyor belt 20. The size of an area of image capture by the second score line camera 52 can be determined appropriately. An area of image capture by the second score line camera 52 is only required to have a size that allows image capture at least of tablets in five columns and in one row facing the second score line camera 52. Unlike that of the conveyor drum 10, the conveyance surface of the first conveyor belt 20 is substantially planar. Thus, even if an area of image capture by the second score line camera 52 is large, this image capture area can entirely be brought into focus relatively easily.

The third score line camera 53 is installed to face a conveyance surface of the second conveyor belt 30 so as to set an image capture area at this conveyance surface. The third score line camera 53 is provided at a position that allows image capture of a place downstream from a position facing the first conveyor belt 20 and upstream from the second ink-jet head 62 in a conveyance direction of the second conveyor belt 30. The third score line camera 53 captures an image of a plurality of tablets being conveyed while being held under suction by the second conveyor belt 30. The size of an area of image capture by the third score line camera 53 can be determined appropriately. An area of image capture by the third score line camera 53 is only required to have a size that allows image capture at least of tablets in five columns and in one row facing the third score line camera 53. Like in the case of the second score line camera 52, the conveyance surface of the second conveyor belt 30 is substantially planar. Thus, even if an area of image capture by the third score line camera 53 is large, this image capture area can entirely be brought into focus relatively easily.

Each of the first and second ink-jet heads 61 and 62 includes a plurality of discharge nozzles. Ink droplets are discharged through the discharge nozzles by an ink-jet system. The ink-jet system may be a piezo system according to which a piezo element (piezoelectric element) is deformed by applying a voltage to the piezo element, thereby discharging ink droplets. Alternatively, the ink-jet system may be a thermal system according to which ink is heated by conducting a current through a heater, thereby discharging ink droplets. In this embodiment, to perform printing process on a tablet as a medicine, edible ink manufactured by a material permitted under the Food Sanitation Law is used as ink to be discharged from the first and second ink-jet heads 61 and 62. The first and second ink-jet heads 61 and 62 can discharge inks in four colors including cyan (C), magenta (M), yellow (Y), and black (K). A color print can be produced by mixing these inks.

The first ink-jet head 61 is arranged downstream from the second score line camera 52 in the conveyance direction of the first conveyor belt 20. The first ink-jet head 61 performs printing process on a plurality of tablets being conveyed while being held under suction by the first conveyor belt 20. The second ink-jet head 62 is arranged downstream from the third score line camera 53 in the conveyance direction of the second conveyor belt 30. The second ink-jet head 62 performs printing process on a plurality of tablets being conveyed while being held under suction by the second conveyor belt 30. The first and second ink-jet heads 61 and 62 are preferably full-line heads that cover an entire area of the first conveyor belt 20 in its width direction and an entire area of the second conveyor belt 30 in its width direction respectively.

The tablet printing apparatus 1 further includes a first test camera 71 and a second test camera 72. Like the aforementioned score line cameras, a CCD camera is usable as each of the first and second test cameras 71 and 72. The first test camera 71 is installed to face the conveyance surface of the second conveyor belt 30 so as to set an image capture area at this conveyance surface. The first test camera 71 is provided at a position that allows image capture of a place downstream from the second ink-jet head 62 in the conveyance direction of the second conveyor belt 30. The first test camera 71 captures an image of a plurality of tablets being conveyed while being held under suction by the second conveyor belt 30. As shown in FIG. 1, the first test camera 71 is provided below the second conveyor belt 30. Meanwhile, a tablet is conveyed by the second conveyor belt 30 while being held under suction. Thus, even if the tablet is pointed downwardly (even if a suction hole is exposed downwardly), the tablet can be conveyed without falling.

The second test camera 72 is installed to face a conveyance surface of the third conveyor belt 40 so as to set an image capture area at this conveyance surface. The second test camera 72 captures an image of a plurality of tablets being conveyed while being held under suction by the third conveyor belt 40.

The tablet printing apparatus 1 further includes a first heater 76 and a second heater 77. A hot-air drying heater of heating and drying a tablet by blowing hot air is usable as each of the first and second heaters 76 and 77, for example. The first heater 76 is arranged downstream from the first ink-jet head 61 in the conveyance direction of the first conveyor belt 20. The first heater 76 blows hot air toward a tablet having been subjected to printing process by the first ink-jet head 61 to dry this tablet.

The second heater 77 is arranged downstream from the second ink-jet head 62 in the conveyance direction of the second conveyor belt 30. The second heater 77 blows hot air toward a tablet having been subjected to printing process by the second ink-jet head 62 to dry this tablet. The first and second heaters 76 and 77 are provided below the first and second conveyor belts 20 and 30 respectively. Meanwhile, as described above, a tablet is conveyed by each of the first and second conveyor belts 20 and 30 while being held under suction. Thus, even if the tablet is pointed downwardly, the tablet can be conveyed without falling.

The tablet printing apparatus 1 further includes four cleaning mechanisms 81, 82, 83, and 84. Powder generated from a tablet may adhere to the conveyor drum 10, the first conveyor belt 20, the second conveyor belt 30, and the third conveyor belt 40. The cleaning mechanisms 81, 82, 83, and 84 clean the powder off the conveyor drum 10, the first conveyor belt 20, the second conveyor belt 30, and the third conveyor belt 40 respectively. A mechanism of sucking and collecting surrounding atmosphere by blowing air is usable as each of the cleaning mechanisms 81, 82, 83, and 84, for example.

The controller 3 controls the aforementioned various operating mechanisms provided to the tablet printing apparatus 1. The hardware structure of the controller 3 is the same as that of a generally used computer. Specifically, the controller 3 includes a CPU responsible for various arithmetic operations, a ROM that is a read-only memory storing a basic program, a RAM that is a readable and writable memory storing information of various types, and a magnetic disk storing control software and data, etc. Execution of a certain processing program by the CPU of the controller 3 makes process on a tablet go forward in the tablet printing apparatus 1. The controller 3 also has a function as a printing controller that controls the first and second ink-jet heads 61 and 62 based on image data including image data acquired by the first score line camera 51 and image data acquired by the second score line camera 52.

Figure 3:
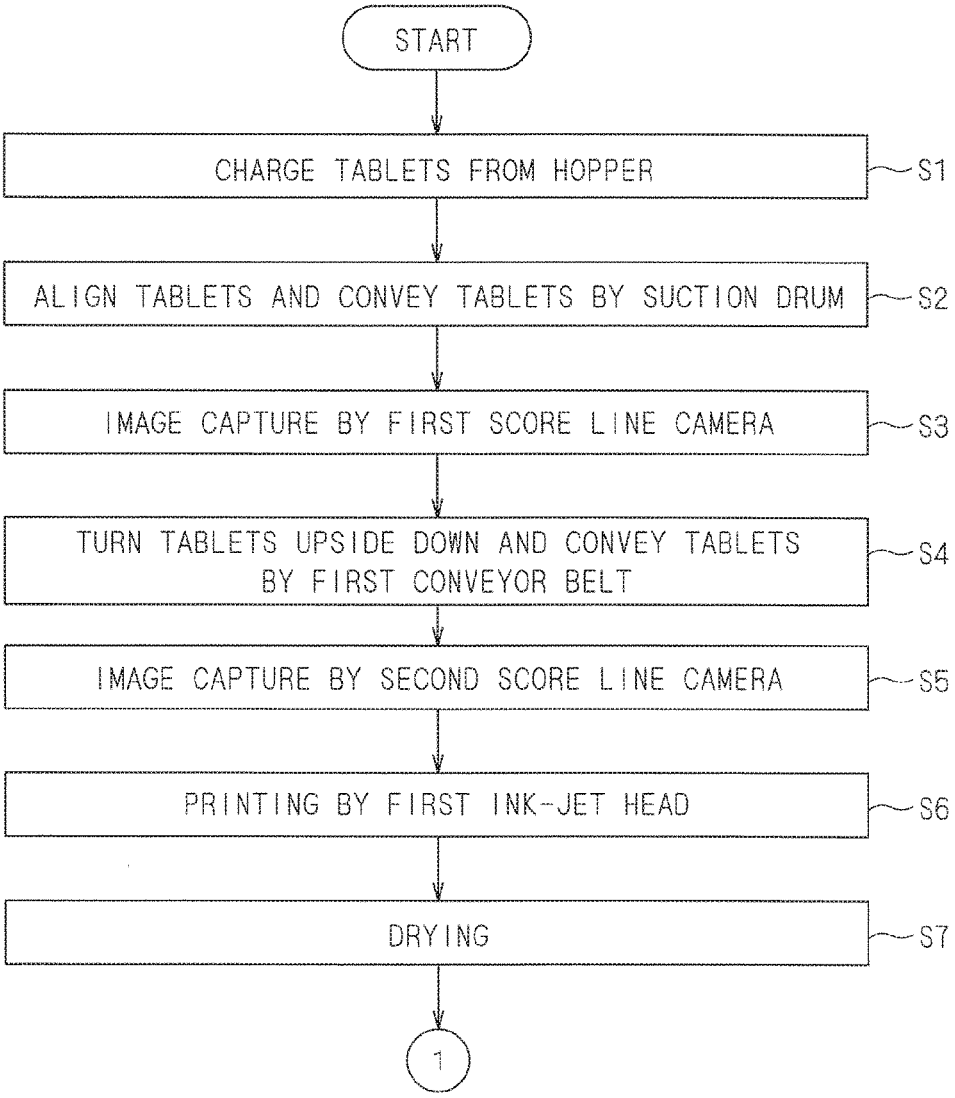
FIG. 3 is a flowchart showing a procedure of an operation in the tablet printing apparatus of FIG. 1.
Figure 4:
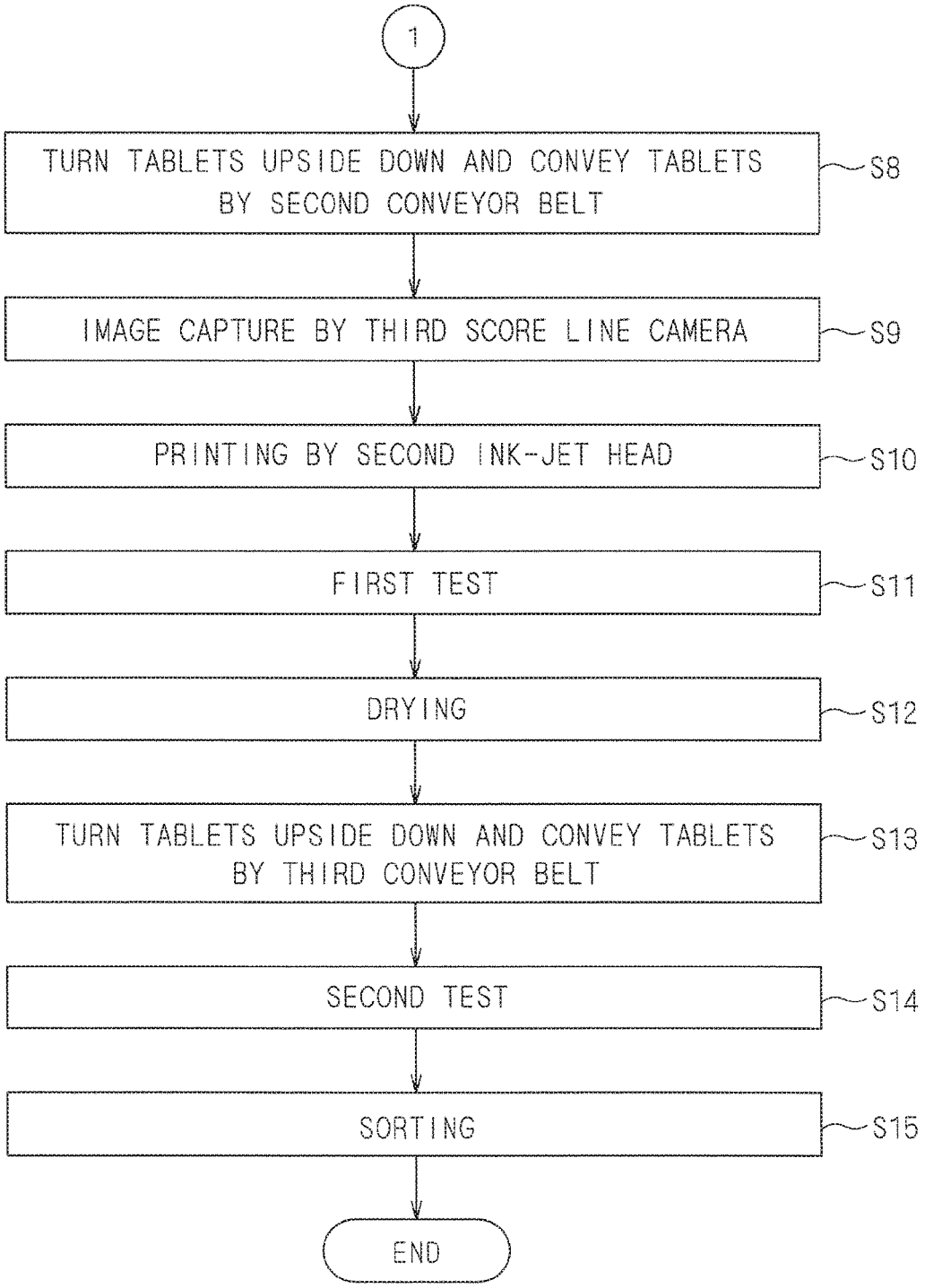
FIG. 4 is a flowchart showing the procedure of the operation in the tablet printing apparatus of FIG. 1.

An operation in the tablet printing apparatus 1 having the aforementioned structure will be described next. FIGS. 3 and 4 are flowcharts showing a procedure of the operation in the tablet printing apparatus 1. First, a plurality of tablets is charged collectively from the hopper 8 of the tablet printing apparatus 1 (step S1). The collective charge of the tablets may be done manually by a worker by using a bucket or automatically by a conveyor mechanism different from the tablet printing apparatus 1. All the tablets to be charged collectively are of the same type.

Figure 5:
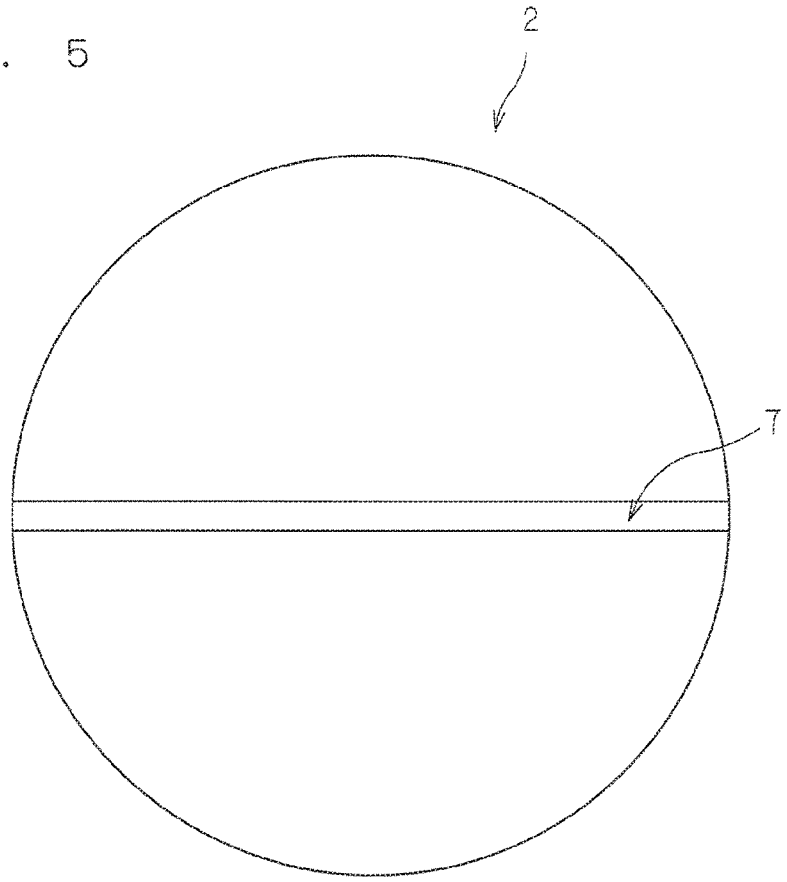
FIG. 5 is a plan view of a tablet.

In this embodiment, a plurality of tablets 2 having a disc-like shape is charged from the hopper 8. FIG. 5 is a plan view of the tablet 2. A score line 7 for portioning the tablet 2 into halves is engraved in one side of the tablet 2. The score line 7 is a groove engraved in the radial direction of the tablet 2 having a disc-like shape. The score line 7 is engraved only in one side of the tablet 2.

In this embodiment, a side with the score line 7 is called a front side of the tablet 2. The score line 7 is not engraved in a back side of the tablet 2. The properties of the tablet 2 as a medical agent do not differ between a front side and a back side. Expressing a side with the score line 7 as a front side is merely for the convenience of discrimination.

The plurality of tablets 2 charged from the hopper 8 is guided to the conveyor drum 10 along the slider 9. Then, these tablets 2 are held under suction one by one in the suction holes 11 of the conveyor drum 10. The conveyor drum 10 is provided with the suction holes 11 in five columns aligned in a direction vertical to the conveyance direction (circumferential direction of the conveyor drum 10), specifically, in the direction of the center axis of the conveyor drum 10. Thus, the conveyor drum 10 conveys the plurality of tablets 2 in five columns while five tablets are aligned in the direction vertical to the conveyance direction. In this description, a unit of five tablets aligned in the direction vertical to the conveyance direction of the conveyor drum 10 is called a "row." Specifically, the conveyor drum 10 conveys the plurality of tablets 2 aligned in five columns and in multiple rows while each of the tablets 2 is held under suction in a corresponding suction hole 11 (step S2). To allow the conveyor drum 10 to smoothly hold the tablets 2 under suction in units of five having been charged from the hopper 8, the hopper 8 may be provided with an alignment mechanism for aligning the plurality of tablets 2 in units of five and feeding the aligned tablets 2. A mechanism of a ball folder system is usable as such an alignment mechanism, for example.

Next, the first score line camera 51 captures an image of the plurality of tablets 2 being conveyed by the conveyor drum 10 (step S3). These tablets 2 are conveyed clockwise on the plane of paper of FIG. 1 in the circumferential direction of the conveyor drum 10 while being held in the suction holes 11 in the conveyor drum 10. The tablets 2 are conveyed while being aligned in five columns. Meanwhile, whether a front side of each tablet 2 is pointed toward the inside of the conveyor drum 10 (toward the center of the conveyor drum 10) or pointed outwardly is determined completely randomly. The circular tablets 2 are to be held in the circular suction holes 11. Thus, the directional properties of the tablets 2 are determined arbitrarily and the orientation of the score line 7 in each tablet 2 being conveyed by the conveyor drum 10 is also determined completely randomly. The first score line camera 51 captures an image of the tablets 2 from a place outside the conveyor drum 10. Thus, the plurality of tablets 2 appearing in the image captured by the first score line camera 51 includes a tablet 2 with a front side pointed toward the first score line camera 51 and a tablet 2 with a back side pointed toward the first score line camera 51 on a random basis.

In other words, the first score line camera 51 captures an image of one sides of the plurality of tablets 2 being conveyed by the conveyor drum 10. The "one side" mentioned herein means an outwardly pointed side of the tablet 2 being conveyed by the conveyor drum 10, irrespective of whether this side is a front side or a back side of the tablet 2.

The first score line camera 51 captures an image of each row including five tablets arranged in the direction vertical to the conveyance direction of the conveyor drum 10. The reason for this image capture is that, as the outer circumferential surface of the conveyor drum 10 has a cylindrical shape, multiple rows cannot be brought into focus easily for image capture by the first score line camera 51.

Figure 6:
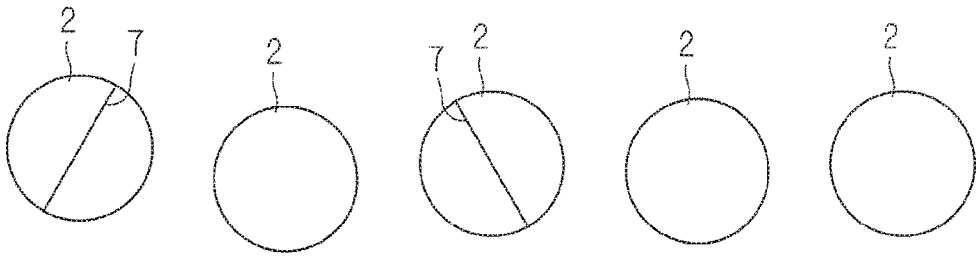
FIG. 6 shows an exemplary result of image capture by a first score line camera.

FIG. 6 shows an exemplary result of the image capture by the first score line camera 51. The first score line camera 51 captures an image of the one sides of the plurality of tablets 2 being conveyed by the conveyor drum 10. Whether a front side of each tablet 2 is pointed outwardly or inwardly is determined randomly while this tablet 2 is held under suction by the conveyor drum 10. Thus, the one sides of the tablets 2 appearing in the image captured by the first score line camera 51 include a front side with the score line 7 and a back side opposite the front side on a random basis. In the example of FIG. 6, regarding tablets 2 arranged in five columns, a front side of a tablet 2 at the left end and a front side of a tablet 2 at the center appear in the image captured by the first score line camera 51. Regarding the other tablets 2, respective back sides appear in the captured image. Image data such as one shown in FIG. 6 representing a result of the image capture by the first score line a is transmitted to the controller 3.

Next, the tablets 2 in five columns and in one row having been subjected to the image capture by the first score line camera 51 are conveyed further by the conveyor drum 10 to reach a position facing the first conveyor belt 20 and adjacent to the first conveyor belt 20. At this time, the blowing mechanism in the conveyor drum 10 blows air toward the five suction holes 11 where the tablets 2 in five columns and in one row are held under suction to release these tablets 2 in five columns and in one row from the sucked condition. Meanwhile, negative pressure acts on the suction holes 21 in the holder plate 22 of the first conveyor belt 20 located at a position facing the conveyor drum 10 and adjacent to the conveyor drum 10. Thus, the tablets 2 in five columns and in one row having been released from the sucked condition formed by the conveyor drum 10 are transferred from the suction holes 11 in the conveyor drum 10 to the suction holes 21 in the first conveyor belt 20 and held under suction in these suction holes 21. To ensure such transfer of the tablets 2, the controller 3 exerts control to make the conveyor drum 10 and the first conveyor belt 20 convey the tablets 2 at the same speed. The controller 3 further exerts control to operate both of these conveyor parts in a synchronized manner so as to make the suction holes 11 and the suction holes 21 face each other correctly.

During the transfer of the tablets 2 from the conveyor drum 10 to the first conveyor belt 20, these tablets 2 move as they are without rotating, etc. Specifically, these tablets 2 are transferred from the conveyor drum 10 to the first conveyor belt 20 while the directions of the respective score lines 7 in the tablets 2 are maintained.

During the transfer of the tablets 2 from the conveyor drum 10 to the first conveyor belt 20, these tablets 2 are turned upside down. Specifically, if a tablet 2 is held under suction by the conveyor drum 10 while a front side of the tablet 2 with the score line 7 is pointed outwardly, this tablet 2 is to be held under suction in the suction hole 21 in the first conveyor belt 20 while a back side of the tablet 2 is pointed outwardly. Conversely, if a tablet 2 is held under suction by the conveyor drum 10 while a back side of the tablet 2 is pointed outwardly, this tablet 2 is to be held under suction by the first conveyor belt 20 while a front side of the tablet 2 is pointed outwardly. Thus, each tablet 2 having been conveyed by the conveyor drum 10 is turned upside down while the direction of the tablet 2 is maintained and is then transferred to the first conveyor belt 20 and conveyed by the first conveyor belt 20 (step S4).

Next, the second score line camera 52 captures an image of the plurality of tablets 2 being conveyed by the first conveyor belt 20 (step S5). The first conveyor belt 20 conveys the plurality of tablets 2 turned upside down having been received from the conveyor drum 10 while aligning these tablets 2 in five columns in a direction vertical to the conveyance direction. The second score line camera 52 captures an image of the tablets 2 from a place outside the first conveyor belt 20. Thus, the plurality of tablets 2 appearing in the image captured by the second score line camera 52 also includes a tablet 2 with a front side pointed toward the second score line camera 52 and a tablet 2 with a back side pointed toward the second score line camera 52 on a random basis. It is to be noted that each tablet 2 is turned upside down when being transferred from the conveyor drum 10 to the first conveyor belt 20. Thus, a front side or a back side of each tablet 2 appearing in the image captured by the second score line camera 52 is completely different from the front side or the back side of this tablet 2 appearing the image captured by the first score line camera 51.

In other words, the second score line camera 52 captures the image of opposite sides of the plurality of tablets 2 being conveyed by the first conveyor belt 20. The "opposite side" mentioned herein means an opposite side to the aforementioned one side and is an outwardly pointed side of the tablet 2 being conveyed by the first conveyor belt 20, irrespective of whether this side is a front side or a back side of the tablet 2.

The conveyance surface of the first conveyor belt 20 is substantially planar. This allows the second score line camera 52 to capture an image of the tablets 2 extending over multiple rows. Meanwhile, in this embodiment, for conformity with a range of the image capture by the first score line camera 51, the second score line camera 52 also captures an image of each row including five tablets arranged in the direction vertical to the conveyance direction of the first conveyor belt 20.

Figure 7:
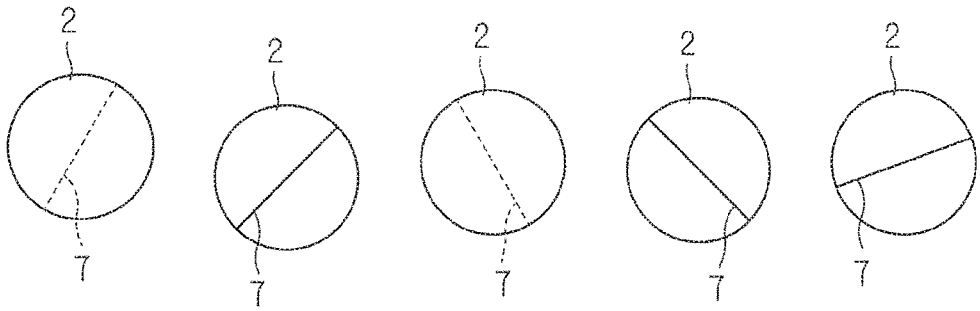
FIG. 7 shows an exemplary result of image capture by a second score line camera.

FIG. 7 shows an exemplary result of the image capture by the second score line camera 52. The second score line camera 52 captures an image of the opposite sides of the plurality of tablets 2 being conveyed by the first conveyor belt 20. These opposite sides are opposite the one sides of the plurality of tablets 2 appearing in the image captured by the first score line camera 51. Thus, if the first score line camera 51 captures an image of a front side of a tablet 2, the second score line camera 52 is to capture an image of a back side of this tablet 2. Conversely, if the first score line camera 51 captures an image of a back side of a tablet 2, the second score line camera 52 is to capture an image of a front side of this tablet 2.

In the example of FIG. 7 as the converse to the example of FIG. 6, regarding the tablets 2 arranged in five columns, a back side of the tablet 2 at the left end and a back side of the tablet 2 at the center appear in the image captured by the second score line camera 52. Regarding the other tablets 2, respective front sides with the score lines 7 appear in the captured image. Image data such as one shown in FIG. 7 representing a result of the image capture by the second score line camera 52 is transmitted to the controller 3. Dotted lines of FIG. 7 show score lines 7 in the one sides of the tablets 2 recognized by the image captured by the first score line camera 51 and do not show score lines 7 as subjects of direct image capture by the second score line camera 52.

Figure 8:
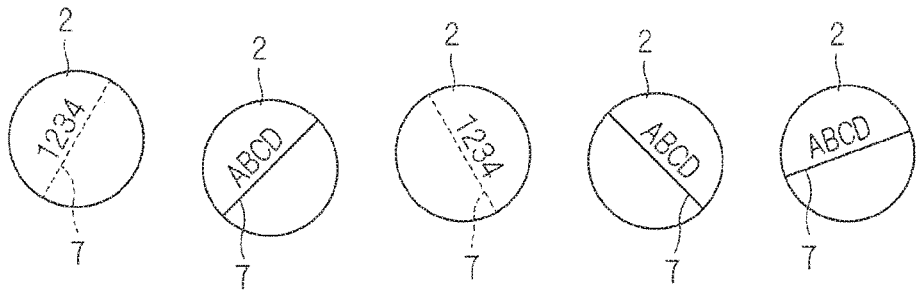
FIG. 8 shows an exemplary result of printing process by a first ink-jet head.

Next, the tablets 2 having been subjected to the image capture by the second score line camera 52 are conveyed further by the first conveyor belt 20 to reach a position facing the first ink-jet head 61. Then, the first ink-jet head 61 performs printing process on the tablets 2 (step S6). At this time, the controller 3 controls the printing process by the first ink-jet head 61 based on the image data acquired by the first score line camera 51 and the image data acquired by the second score line camera 52. FIG. 8 shows an exemplary result of the printing process by the first ink-jet head 61.

As described above, the first score line camera 51 captures an image of one sides of the plurality of tablets 2 being conveyed by the conveyor drum 10. During transfer of the tablets 2 from the conveyor drum 10 to the first conveyor belt 20, all these tablets 2 are turned upside down. Then, the second score line camera 52 captures an image of opposite sides of the plurality of tablets 2 being conveyed by the first conveyor belt 20. Thus, image data is acquired by image capture of both a front side and a back side of each tablet 2 by the first and second score line cameras 51 and 52. More specifically, if the first score line camera 51 captures an image of a front side of a tablet 2, the second score line camera 52 is to capture an image of a back side of this tablet 2 (in the examples of FIGS. 6 and 7, the tablets 2 at the left end and at the center). Conversely, if the first score line camera 51 captures an image of a back side of a tablet 2, the second score line camera 52 is to capture an image of a front side of this tablet 2 (in the examples of FIGS. 6 and 7, the second, fourth, and fifth tablets 2 from the left).

The first ink-jet head 61 is to perform printing process on the opposite sides of the plurality of tablets 2 being conveyed by the first conveyor belt 20. The controller 3 makes the first ink-jet head 61 perform front-side printing process on a tablet 2 out of the plurality of tablets 2 being conveyed by the first conveyor belt 20 and having a front side defining its opposite side (in the examples of FIGS. 7 and 8, the second, fourth, and fifth tablets 2 from the left) based on front-side print data. For example, the front-side print data mentioned herein is character data "ABCD."

The controller 3 makes the first ink-jet head 61 perform the front-side printing process on the front side of this tablet 2 to conform to a predetermined direction relative to the score line 7 engraved in this front side. In this embodiment, the first ink-jet head 61 performs the printing process in a direction parallel to the score line 7 in the front side of the tablet 2. Regarding the tablet 2 out of the plurality of tablets 2 being conveyed by the first conveyor belt 20 and having a front side defining its opposite side, the direction of the score line 7 in this tablet 2 can be recognized by the controller 3 by performing image processing on the image data acquired by the second score line camera 52 (directions of the score lines 7 indicated by solid lines of FIG. 8). As a result, as shown in FIG. 8, a character string "ABCD" is printed by the first ink-jet head 61 on the front side of the tablet 2 out of the plurality of tablets 2 being conveyed by the first conveyor belt 20 and having a front side defining its opposite side to extend in a direction parallel to the score line 7 engraved in this front side.

The controller 3 makes the first ink-jet head 61 perform back-side printing process on a tablet 2 out of the plurality of tablets 2 being conveyed by the first conveyor belt 20 and having a back side defining its opposite side (in the examples of FIGS. 7 and 8, the tablets 2 at the left end and at the center) based on back-side print data. For example, the back-side print data mentioned herein is character data "1234."

The controller 3 makes the first ink-jet head 61 perform the back-side printing process on the back side of this tablet 2 to conform to a direction same as the aforementioned, predetermined direction relative to the score line 7 engraved in the front side of this tablet 2. In this embodiment, the printing process is performed on a front side of a tablet 2 in a direction parallel to the score line 7. The first ink-jet head 61 performs the printing process on a back side of the tablet 2 also in the direction parallel to the score line 7 in the front side of this tablet 2. Regarding the tablet 2 out of the plurality of tablets 2 being conveyed by the first conveyor belt 20 and having a back side defining its opposite side, the direction of the score line 7 in a front side of this tablet 2 can be recognized by the controller 3 by performing image processing on the image data acquired by the first score line camera 51 (directions of the score lines 7 indicated by dotted lines of FIG. 8). As a result, as shown in FIG. 8, a character string "1234" is printed by the first ink-jet head 61 on the back side of the tablet 2 out of the plurality of tablets 2 being conveyed by the first conveyor belt 20 and having a back side defining its opposite side to extend in a direction parallel to the score line 7 engraved in the corresponding front side.

Further, the controller 3 makes fine adjustment (correction) on a position of the printing on each tablet 2 by the first ink-jet head 61 based on the image data acquired by the second score line camera 52. The size of the suction holes 21 in the first conveyor belt 20 is slightly larger than that of the tablets 2. Thus, during transfer of the tablets 2 from the conveyor drum 10 to the first conveyor belt 20, while the directional properties of each tablet 2 are maintained, the position of this tablet 2 is slightly changed within the range of the suction hole 21. The controller 3 detects a position shift of each tablet 2 in the suction hole 21 based on the image data acquired by the second score line camera 52 and makes fine adjustment on a printing position based on a result of the detection. In this way, the printing process is performed on the opposite sides of the plurality of tablets 2.

Next, the tablets 2 having been subjected to the printing process on their opposite sides are conveyed further by the first conveyor belt 20 to reach a position facing the first heater 76. As shown in FIG. 1, the first heater 76 is installed below the first conveyor belt 20. When the tablets 2 reach the position facing the first heater 76, these tablets 2 are held while being pointed downwardly by the first conveyor belt 20. The first conveyor belt 20 holds the tablets 2 under suction by making negative pressure act on the suction holes 21. In this way, the tablets 2 can be held even in a downwardly pointed posture.

The first heater 76 dries the plurality of tablets 2 being conveyed by the first conveyor belt 20 by blowing hot air toward the opposite sides of these tablets 2 (step S7). As a result of this drying process, ink discharged from the first ink-jet head 61 to the plurality of tablets 2 can be dried rapidly to prevent bleed of the ink.

Next, the tablets 2 in five columns and in one row having been dried by the first heater 76 are conveyed further by the first conveyor belt 20 to reach a position facing the second conveyor belt 30 and adjacent to the second conveyor belt 30. At this time, the blowing mechanism in the first conveyor belt 20 blows air toward the five suction holes 21 where the tablets 2 in five columns and in one row are held under suction to release these tablets 2 in five columns and in one row from the sucked condition. Meanwhile, negative pressure acts on the suction holes in the second conveyor belt 30 located at a position facing the first conveyor belt 20 and adjacent to the first conveyor belt 20. Thus, the tablets 2 in five columns and in one row having been released from the sucked condition formed by the first conveyor belt 20 are transferred from the suction holes 21 in the first conveyor belt 20 to the suction holes in the second conveyor belt 30 and held under suction in these suction holes. To ensure such transfer of the tablets 2, the controller 3 exerts control to make the first and second conveyor belts 20 and 30 convey the tablets 2 at the same speed. The controller 3 further exerts control to operate both of these conveyor belts in a synchronized manner so as to make the suction holes in both of these conveyor belts face each other correctly.

During the transfer of the tablets 2 from the first conveyor belt 20 to the second conveyor belt 30, these tablets 2 move as they are without rotating, etc. Specifically, these tablets 2 are transferred from the first conveyor belt 20 to the second conveyor belt 30 while the directions of the respective score lines 7 in the tablets 2 are maintained.

During the transfer of the tablets 2 from the first conveyor belt 20 to the second conveyor belt 30, these tablets 2 are turned upside down. Specifically, if a tablet 2 is held under suction by the first conveyor belt 20 while a front side of the tablet 2 with the score line 7 is pointed outwardly, this tablet 2 is to be held under suction by the second conveyor belt 30 while a back side of the tablet 2 is pointed outwardly. Conversely, if a tablet 2 is held under suction by the first conveyor belt 20 while a back side of the tablet 2 is pointed outwardly, this tablet 2 is to be held under suction by the second conveyor belt 30 while a front side of the tablet 2 is pointed outwardly. Thus, each tablet 2 having been conveyed by the first conveyor belt 20 is turned upside down while the direction of the tablet 2 is maintained and is then transferred to the second conveyor belt 30 and conveyed by the second conveyor belt 30 (step S8).

Next, the third score line camera 53 captures an image of the plurality of tablets 2 being conveyed by the second conveyor belt 30 (step S9). The second conveyor belt 30 conveys the plurality of tablets 2 turned upside down having been received from the first conveyor belt 20 while aligning these tablets 2 in five columns in a direction vertical to the conveyance direction. The third score line camera 53 captures an image of the tablets 2 from a place outside the second conveyor belt 30. Thus, a front side or a back side of each tablet 2 appearing in the image captured by the third score line camera 53 is completely different from the front side or the back side of this tablet 2 appearing in the image captured by the second score line camera 52, while completely agreeing with the front side or the back side of this tablet 2 appearing in the image captured by the first score line camera 51. Specifically, like the first score line camera 51, the third score line camera 53 captures an image of the one sides of the plurality of tablets 2 being conveyed by the second conveyor belt 30.

The conveyance surface of the second conveyor belt 30 is substantially planar. This allows the third score line camera 53 to capture an image of the tablets 2 extending over multiple rows. Meanwhile, in this embodiment, for conformity with a range of the image capture by the first score line camera 51, the third score line camera 53 also captures an image of each row including five tablets arranged in the direction vertical to the conveyance direction of the second conveyor belt 30.

Figure 9:
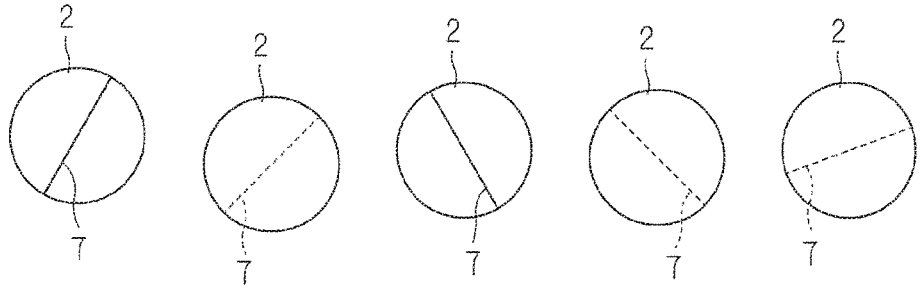
FIG. 9 shows an exemplary result of image capture by a third score line camera.

FIG. 9 shows an exemplary result of the image capture by the third score line camera 53. Like the first score line camera 51, the third score line camera 53 captures an image of the one sides of the plurality of tablets 2 being conveyed by the second conveyor belt 30. Thus, a result of the image capture by the third score line camera 53 is substantially the same as the result of the image capture by the first score line camera 51. In particular, the result of the image capture by the third score line 53 completely agrees with the result of the image capture by the first score line camera 51 in terms of the directional properties of each tablet 2.

Like in the example of FIG. 6, in the example of FIG. 9, regarding the tablets 2 arranged in five columns, the front side with the score line 7 of the tablet 2 at the left end and the front side with the score line 7 of the tablet 2 at the center appear in the image captured by the third score line camera 53. Regarding the other tablets 2, respective back sides appear in the captured image. Image data such as one shown in FIG. 9 representing a result of the image capture by the third score line camera 53 is transmitted to the controller 3. Dotted lines of FIG. 9 show score lines 7 in the opposite sides of the tablets 2 recognized by the image capture by the second score line camera 52 and do not show score lines 7 as subjects of direct image capture by the third score line camera 53.

The controller 3 does not recognize the direction of the score line 7 engraved in the front side of the tablet 2 based on the image data acquired by the third score line camera 53. The reason for this is that, regarding a tablet 2 having a front side defining its one side, the direction of the score line 7 in this tablet 2 has already been recognized using the image data acquired by the first score line camera 51 so the direction of this score line 7 is not required to be recognized again. If anything, if the image data acquired by the third score line camera 53 is used for recognition of the direction of the score line 7 by the controller 3, it becomes likely that a print will be produced while being reversed 180 degrees during printing process by the second ink-jet head 62 described later.

The image capture by the third score line camera 53 is intended to detect shift in the positions of the plurality of tablets 2 held under suction by the second conveyor belt 30. The controller 3 detects a position shift of each tablet 2 in the suction hole in the second conveyor belt 30 based on the image data acquired by the third score line camera 53.

Figure 10:
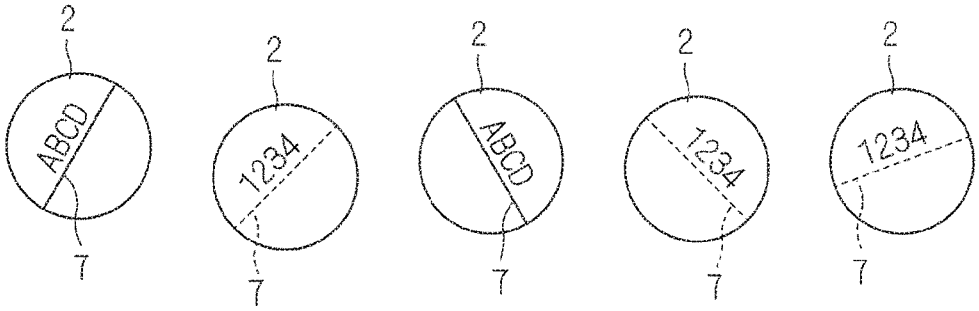
FIG. 10 shows an exemplary result of printing process by a second ink-jet head.

Next, the tablets 2 having been subjected to the image capture by the third score line camera 53 are conveyed further by the second conveyor belt 30 to reach a position facing the second ink-jet head 62. Then, the second ink-jet head 62 performs printing process on the tablets 2 (step S10). At this time, the controller 3 controls the printing process by the second ink-jet head 62 based on the image data acquired by the first score line camera 51 and the image data acquired by the second score line camera 52. FIG. 10 shows an exemplary result of the printing process by the second ink-jet head 62.

The second ink-jet head 62 is to perform printing process on the one sides of the plurality of tablets 2 being conveyed by the second conveyor belt 30. The controller 3 makes the second ink-jet head 62 perform front-side printing process on a tablet 2 out of the plurality of tablets 2 being conveyed by the second conveyor belt 30 and having a front side defining its one side (in the examples of FIGS. 9 and 10, the tablets 2 at the left end and at the center) based on front-side print data. Like the aforementioned front-side print data, the front-side print data mentioned herein is character data "ABCD."

The controller 3 makes the second ink-jet head 62 perform the front-side printing process on the front side of the this tablet 2 to conform to the aforementioned predetermined direction relative to the score line 7 engraved in this front side. In this embodiment, the second ink-jet head 62 performs the printing process in a direction parallel to the score line 7 in the front side of the tablet 2. Regarding the tablet 2 out of the plurality of tablets 2 being conveyed by the second conveyor belt 30 and having a front side defining its one side, the direction of the score line 7 in this tablet 2 can be recognized by the controller 3 by performing image processing on the image data acquired by the first score line camera 51 (directions of the score lines 7 indicated by solid lines of FIG. 10). As a result, as shown in FIG. 10, a character string "ABCD" is printed by the second ink-jet head 62 on the front side of the tablet 2 out of the plurality of tablets 2 being conveyed by the second conveyor belt 30 and having a front side defining its one side to extend in a direction parallel to the score line 7 engraved in this front side.

The controller 3 makes the second ink-jet head 62 perform back-side printing process on a tablet 2 out of the plurality of tablets 2 being conveyed by the second conveyor belt 30 and having a back side defining its one side (in the examples of FIGS. 9 and 10, the second, fourth, and fifth tablets 2 from the left) based on back-side print data. Like the aforementioned back-side print data, the back-side print data mentioned herein is character data "1234."

The controller 3 makes the second ink-jet head 62 perform the back-side printing process on the back side of this tablet 2 to conform to a direction same as the aforementioned predetermined direction relative to the score line 7 engraved in the front side of this tablet 2. In this embodiment, the printing process is performed on a front side of a tablet 2 in a direction parallel to the score line 7. The second ink-jet head 62 performs the printing process on a back side of the tablet 2 also in the direction parallel to the score line 7 in the front side of this tablet 2. Regarding the tablet 2 out of the plurality of tablets 2 being conveyed by the second conveyor belt 30 and having a back side defining its one side, the direction of the score line 7 in a front side of this tablet 2 can be recognized by the controller 3 by performing image processing on the image data acquired by the second score line camera 52 (directions of the score lines 7 indicated by dotted lines of FIG. 10). As a result, as shown in FIG. 10, a character string "1234" is printed by the second ink-jet head 62 on the back side of the tablet 2 out of the plurality of tablets 2 being conveyed by the second conveyor belt 30 and having a back side defining its one side to extend in a direction parallel to the score line 7 engraved in the corresponding front side.

Further, the controller 3 makes fine adjustment (correction) on a position of printing on each tablet 2 by the second ink-jet head 62 based on the image data acquired by the third score line camera 53. Like in the aforementioned case, during transfer of the tablets 2 from the first conveyor belt 20 to the second conveyor belt 30, while the directional properties of each tablet 2 are maintained, the position of this tablet 2 is slightly changed within the range of the suction hole. The controller 3 detects a position shift of each tablet 2 in the suction hole in the second conveyor belt 30 based on the image data acquired by the third score line camera 53 and makes fine adjustment on a printing position based on a result of the detection. In this way, the printing process is performed on the one sides of the plurality of tablets 2.

Next, the tablets 2 having been subjected to the printing process on their one sides are conveyed further by the second conveyor belt 30 to reach a position facing the first test camera 71. The first test camera 71 captures an image of the one sides of the plurality of tablets 2 being conveyed by the second conveyor belt 30 to obtain an image representing a result of the printing process on the one sides of the plurality of tablets 2 by the second ink-jet head 62. The first test camera 71 transmits acquired data about the image to the controller 3. Based on the image data acquired by the first test camera 71, the controller 3 checks the result of the printing process on the one sides of the plurality of tablets 2 by the second ink-jet head 62 (step S11).

Next, the tablets 2 having been subjected to the check of the result of the printing process on their one sides are conveyed further by the second conveyor belt 30 to reach a position facing the second heater 77. The second heater 77 dries the plurality of tablets 2 being conveyed by the second conveyor belt 30 by blowing hot air toward the one sides of these tablets 2 (step S12). As a result of this drying process, ink discharged from the second ink-jet head 62 to the plurality of tablets 2 can be dried rapidly to prevent bleed of the ink.

Next, the tablets 2 in five columns and in one row having been dried by the second heater 77 are conveyed further by the second conveyor belt 30 to reach a position facing the third conveyor belt 40 and adjacent to the third conveyor belt 40. At this time, the blowing mechanism in the second conveyor belt 30 blows air toward the five suction holes where the tablets 2 in five columns and in one row are held under suction to release these tablets 2 in five columns and in one row from the sucked condition. Meanwhile, negative pressure acts on the suction holes in the third conveyor belt 40 located at a position facing the second conveyor belt 30 and adjacent to the second conveyor belt 30. Thus, the tablets 2 in five columns and in one row having been released from the sucked condition formed by the second conveyor belt 30 are transferred from the suction holes in the second conveyor belt 30 to the suction holes in the third conveyor belt 40 and held under suction in these suction holes. To ensure such transfer of the tablets 2, the controller 3 exerts control to make the second and third conveyor belts 30 and 40 convey the tablets 2 at the same speed. The controller 3 further exerts control to operate both of these conveyor belts in a synchronized manner so as to make the suction holes in both of these conveyor belts face each other correctly.

During the transfer of the tablets 2 from the second conveyor belt 30 to the third conveyor belt 40, these tablets 2 move as they are without rotating, etc. Specifically, these tablets 2 are transferred from the second conveyor belt 30 to the third conveyor belt 40 white the directions of the respective score lines 7 in the tablets 2 are maintained.

During the transfer of the tablets 2 from the second conveyor belt 30 to the third conveyor belt 40, these tablets 2 are turned upside down. Specifically, if a tablet 2 is held under suction by the second conveyor belt 30 while a front side of the tablet 2 with the score line 7 is pointed outwardly, this tablet 2 is to be held under suction by the third conveyor belt 40 while a back side of the tablet 2 is pointed outwardly. Conversely, if a tablet 2 is held under suction by the second conveyor belt 30 while a back side of the tablet 2 is pointed outwardly, this tablet 2 is to be held under suction by the third conveyor belt 40 while a front side of the tablet 2 is pointed outwardly. Thus, each tablet 2 having been conveyed by the second conveyor belt 30 is turned upside down while the direction of the tablet 2 is maintained and is then transferred to the third conveyor belt 40 and conveyed by the third conveyor belt 40 (step S13).

Next, the second test camera 72 captures an image of the plurality of tablets 2 being conveyed by the third conveyor belt 40. Like the first conveyor belt 20, the third conveyor belt 40 holds the plurality of tablets 2 under suction while pointing the opposite sides of these tablets 2 outwardly. Thus, the second test camera 72 captures an image of the opposite sides of the plurality of tablets 2 being conveyed by the third conveyor belt 40 to obtain an image representing a result of the printing process on the opposite sides of the plurality of tablets 2 by the first ink-jet head 61. The second test camera 72 transmits acquired data about the image to the controller 3. Based on the image data acquired by the second test camera 72, the controller 3 checks the result of the printing process on the opposite sides of the plurality of tablets 2 by the first ink-jet head 61 (step S14).

Finally, the tablets 2 having being subjected to the tests both on their front sides and their back sides are subjected to sorting (step S15). A tablet 2 found to be acceptable as a result of the tests on both on its front side and its back side in steps S11 and S14, specifically, a tablet 2 as a conforming item is charged into the conforming item duct 48 by blow of air from the blowing mechanism. The tablet 2 having been charged into the conforming item duct 48 is collected in the conforming item collection box 58. By contrast, a tablet 2 found to be defective as a result of either of the tests on both on its front side and its back side, specifically, a tablet 2 as a defective item is charged into the defective item duct 46 by blow of air from the blowing mechanism. The tablet 2 having been charged into the defective item duct 46 is collected in the defective item box 56. In this way, the printing process on the tablets 2 is finished in the tablet printing apparatus 1.

According to this embodiment, based on image data about both front sides and back sides of a plurality of tablets 2 acquired by the first and second score line cameras 51 and 52, the front-side printing process is performed on a front side of a tablet 2 to conform to a predetermined direction relative to the score line 7 in this front side. Further, the back-side printing process is performed on a back side of a tablet 2 to conform to a direction on the back side same as the aforementioned predetermined direction. This makes it possible to perform the printing process on both the front side and the back side of the tablet 2 in the same direction relative to the score line 7.

While the embodiment of the present invention has been described above, not only the aforementioned embodiment but also numerous modifications can be devised without departing from the scope of the invention. For example, in each of the aforementioned embodiments, the printing process is preformed on a front side and a back side to conform to a direction parallel to the score line 7 in a tablet 2. However, this is not the only direction of the printing process. The printing process can be performed in any direction relative to the score line 7, as long as this direction is common to a front side and a back side of the tablet 2.

A basis for determining a direction of the printing process is not limited to the score line 7. Such a basis is only required to be a mark for identification of a direction. Such a mark may be an arrow engraved in a front side of a tablet 2, for example. With a mark usable for identification of a direction, printing process can be performed in the same way as the aforementioned embodiment to conform to a predetermined direction relative to the mark.

In the aforementioned embodiment, the score line 7 is engraved in a front side of the tablet 2. As described, expressing a side with the score line 7 as a front side is merely for the sake of convenience. Alternatively, a side with the score line 7 may be expressed as a back side.

The shape of a tablet 2 is not limited to a disc-like shape but it may also be a substantially oval shape or a rod shape. In either case, a suction hole in each convey part has a shape conforming to the shape of the tablet 2.

In the aforementioned embodiment, tablets 2 are conveyed in units of five columns and one row. However, this is not the only unit of the conveyance but tablets 2 may also be conveyed in one column or in multiple columns such as two or more columns.

In the aforementioned embodiment, a tablet 2 is categorized as a conforming item or a defective item based on test results acquired by the first and second score line cameras 51 and 52. Alternatively, the tablet printing apparatus 1 permits selection of a mode according to which only printing process is performed while a test is not conducted. If such a mode is selected, all tablets 2 having been subjected to the printing process are charged into the untested duct 47 from the third conveyor belt 40. The tablets 2 having been charged into the untested duct 47 are collected in the untested box 57. Still alternatively, the tablet printing apparatus 1 may have a mode of only conducting a test an untested tablet 2.

INDUSTRIAL APPLICABILITY

The tablet printing apparatus and the tablet printing method according to the present invention can be employed preferably for making prints on both a front side and a back side such as those of a tablet as a medicine in which a score line is engraved.

REFERENCE SIGNS LIST

1 Tablet printing apparatus
2 Tablet
3 Controller
7 Score
8 Hopper
10 Conveyor drum
20 First conveyor belt
30 Second conveyor belt
40 Third conveyor belt
51 First score line camera
52 Second score line camera
53 Third score line camera
61 First ink-jet head
62 Second ink-jet head
71 First test camera
72 Second test camera
76 First heater
77 Second heater

The invention claimed is:

1. A tablet printing apparatus that performs printing process on a front side and a back side of a tablet having a mark for identification of a direction formed at the front side, the tablet printing apparatus comprising:

a charging part for charging of a plurality of tablets;

a first conveyor part that conveys said tablets charged from said charging part;

a first image capturing part that captures an image of one sides of said tablets being conveyed by said first conveyor part;

a second conveyor part that receives said tablets having been conveyed by said first conveyor part from said first conveyor part while said tablets are turned upside down and then conveys said tablets;

a second image capturing part that captures an image of opposite sides of said tablets being conveyed by said second conveyor part;

a first printing part that performs printing process on said opposite sides of said tablets being conveyed by said second conveyor part;

a third conveyor part that receives said tablets having been conveyed by said second conveyor part from said second conveyor part while said tablets are turned upside down and then conveys said tablets;

a second printing part that performs printing process on said one sides of said tablets being conveyed by said third conveyor part; and a printing controller that controls said first printing part and said second printing part based on image data acquired by said first image capturing part and image data acquired by said second image capturing part, wherein said printing controller makes said first printing part perform front-side printing process on each tablet out of said tablets being conveyed by said second conveyor part and having a front side defining its opposite side based on front-side print data to conform to a predetermined direction relative to said mark at said front side, said printing controller makes said first printing part perform back-side printing process on each tablet out of said tablets being conveyed by said second conveyor part and having a back side defining its opposite side based on back-side print data to conform to a direction on said back side same as said predetermined direction, said printing controller makes said second printing part perform front-side printing process on each tablet out of said tablets being conveyed by said third conveyor part and having a front side defining its one side based on front-side print data to conform to said predetermined direction relative to said mark at said front side, and said printing controller makes said second printing part perform back-side printing process on each tablet out of said tablets being conveyed by said third conveyor part and having a back side defining its one side based on back-side print data to conform to a direction on said back side same as said predetermined direction.

2. The tablet printing apparatus according to claim 1, wherein said mark is a score line engraved in a front side of each tablet.

3. The tablet printing apparatus according to claim 1, wherein each of said first conveyor part, said second conveyor part, and said third conveyor part conveys said tablets while aligning a predetermined number of tablets in a direction vertical to a conveyance direction.

4. The tablet printing apparatus according to claim 3, wherein said first image capturing part captures an image of each row including said predetermined number of tablets arranged in said direction vertical to said conveyance direction of said first conveyor part.

5. The tablet printing apparatus according to claim 1, further comprising:

a third image capturing part that captures an image of said one sides of said tablets being conveyed by said third conveyor part, wherein said printing controller corrects a position of printing by said second printing part based on image data acquired by said third image capturing part.

6. The tablet printing apparatus according to claim 1, further comprising:

a first test camera that captures an image of a result of said printing process on said one sides of said tablets by said second printing part; and a second test camera that captures an image of a result of said printing process on said opposite sides of said tablets by said first printing part.

7. The tablet printing apparatus according to claim 1, further comprising:

a first heater that heats and dries said tablets having been subjected to said printing process by said first printing part; and a second heater that heats and dries said tablets having been subjected to said printing process by said second printing part.

8. The tablet printing apparatus according to claim 1, wherein said second conveyor part receives said tablets turned upside down while a direction of said marks is maintained, and said third conveyor part receives said tablets turned upside down while a direction of said marks is maintained.

9. A tablet printing method that performs printing process on a front side and a back side of a tablet having a mark for identification of a direction formed at the front side, the tablet printing method comprising:

a first conveying step of conveying a plurality of tablets;

a first image capturing step of capturing an image of one sides of said tablets being conveyed in said first conveying step;

a second conveying step of conveying said tablets having been conveyed in said first conveying step while turning said tablets upside down;

a second image capturing step of capturing an image of opposite sides of said tablets being conveyed in said second conveying step;

a first printing step of performing printing process on said opposite sides of said tablets being conveyed in said second conveying step;

a third conveying step of conveying said tablets having been conveyed in said second conveying step while turning said tablets upside down; and a second printing step of performing printing process on said one sides of said tablets being conveyed in said third conveying step, wherein in said first printing step, based on image data acquired in said first image capturing step and image data acquired in said second image capturing step, front-side printing process is performed on each tablet out of said tablets being conveyed in said second conveying step and having a front side defining its opposite side to conform to a predetermined direction relative to said mark at said front side, and back-side printing process is performed on each tablet out of said tablets being conveyed in said second conveying step and having a back side defining its opposite side to conform to a direction on said back side same as said predetermined direction, and in said second printing step, based on said image data acquired in said first image capturing step and said image data acquired in said second image capturing step, front-side printing process is performed on each tablet out of said tablets being conveyed in said third conveying step and having a front side defining its one side to conform to said predetermined direction relative to said mark at said front side, and back-side printing process is performed on each tablet out of said tablets being conveyed in said third conveying step and having a back side defining its one side to conform to a direction on said back side same as said predetermined direction.

10. The tablet printing method according to claim 9, wherein said mark is a score line engraved in a front side of each tablet.

11. The tablet printing method according to claim 9, wherein in each of said first conveying step, said second conveying step, and said third conveying step, said tablets are conveyed while a predetermined number of tablets are aligned in a direction vertical to a conveyance direction.

12. The tablet printing method according to claim 11, wherein in said first image capturing step, an image of each row is captured that includes said predetermined number of tablets arranged in said direction vertical to said conveyance direction in said first conveying step.

13. The tablet printing method according to claim 9, further comprising:

a third image capturing step of capturing an image of said one sides of said tablets being conveyed in said third conveying step, wherein in said second printing step, a printing position is corrected based on image data acquired in said third image capturing step.

14. The tablet printing method according to claim 9, further comprising:

a first testing step of capturing an image of a result of said printing process on said one sides of said tablets in said second printing step; and a second testing step of capturing an image of a result of said printing process on said opposite sides of said tablets in said first printing step.

15. The tablet printing method according to claim 9, further comprising:

a first drying step of heating and drying said tablets having been subjected to said printing process in said first printing step; and a second drying step of heating and drying said tablets having been subjected to said printing process in said second printing step.

16. The tablet printing method according to claim 9, wherein in said second conveying step, said tablets are turned upside down while a direction of said mark is maintained, and in said third conveying step, said tablets are turned upside down while a direction of said mark is maintained.

17. A tablet printing apparatus that performs a printing process on a front side and a back side of a tablet having a mark for identification of a direction formed at the front side, the tablet printing apparatus comprising:

a first image capturing part that captures an image of one side of a tablet;

a second image capturing part that captures an image of an opposite side of the tablet;

a first printing part that performs printing process on an opposite side of the tablet;

a second printing part that performs printing process on one side of the tablet; and a printing controller that controls said first printing part and said second printing part to perform the printing process on the opposite and one sides of the tablet, respectively, based on image data acquired by said first image capturing part and image data acquired by said second image capturing part, wherein when the opposite side or the one side is the front side of the tablet, said printing controller controls said first printing part or said second printing part to perform a front-side printing process on the front side of the tablet based on front-side print data, the front-side printing process being performed along the direction according to the mark on the front side, and when the opposite side or the one side is the back side of the tablet, said printing controller controls said first printing part or said second printing part to perform a back-side printing process on the back side of the tablet based on back-side print data, the back-side printing process being performed along a same direction as the direction according to the mark on the front side.

18. The tablet printing apparatus according to claim 17, further comprising a conveyor part that turns said tablet upside down while a direction of said mark is maintained.

19. A tablet printing method that performs a printing process on a front side and a back side of a tablet having a mark for identification of a direction formed at the front side, the tablet printing method comprising:

a first image capturing step of capturing an image of one side of the tablet;

a second image capturing step of capturing an image of an opposite side of the tablet;

a first printing step of performing printing process on an opposite side of the tablet; and a second printing step of performing printing process on one side of the tablet, wherein in said first printing step and said second printing step, based on image data acquired in said first image capturing step and image data acquired in said second image capturing step, a front-side printing process is performed on the front side of the tablet along the direction according to the mark on the front side, when the opposite side or the one side is the front side of the tablet, and a back-side printing process is performed on the back side of the tablet along a same direction as the direction according to the mark on the front side, when the opposite side or the one side is the back side of the tablet.

20. The tablet printing method according to claim 19, further comprising a conveying step of turning said tablet upside down while a direction of said mark is maintained.

* * * * *